US005323679A

United States Patent [19]

Riday

[11] Patent Number: 5,323,679

[45] Date of Patent: Jun. 28, 1994

[54] ERGONOMIC MUSICAL INSTRUMENT KEYBOARD

[76] Inventor: Richard B. Riday, 13004 NE. 88th St., Kirkland, Wash. 98033

[21] Appl. No.: 884,905

[22] Filed: May 18, 1992

[51] Int. Cl.[5] ..... G10C 3/12

[52] U.S. Cl. ..... 84/423 R; 84/428

[58] Field of Search ..... 84/423 R, 424, 425, 84/428, 433, 447

[56] References Cited

U.S. PATENT DOCUMENTS

| | | | |
|---|---|---|---|
| 24,021 | 5/1959 | Gould et al. | 84/423 R |
| 1,202,882 | 10/1916 | Nordbo | 84/423 R |
| 4,926,734 | 5/1990 | Rickey | 84/423 R |

*Primary Examiner*—Michael L. Gellner
*Assistant Examiner*—P. Stanzione
*Attorney, Agent, or Firm*—J. E. McTaggart

[57] ABSTRACT

A highly ergonomic keyboard system provides a unified fingering system for both right and left hands in which the fingering is the same in all key signatures with more natural and comfortable thumb and finger positioning than with conventional piano keys, while maintaining hand span capability comparable to that of the conventional keyboard, i.e. at least one octave, and maintaining the convention method of "thumb tuck" to play extended scales and arpeggios. Three or more parallel horizontal one-octave rows of monolithic keys in half-tone increments are offset from each other in a uniform parallelogram-shaped tiered array with a note duplication offset which facilitates an octave span. All keys are made to have a uniform optimal complementary shape and are retained in a novel integrated pivot matrix configuration. Note/key association is visually indicated by white, black and (optionally) gray and/or other colors. The tiered array system allows the design to be expanded systematically to any number of rows to implement a desired total pitch range; row offset in the X- Y- and Z-axes along with the note duplication offset are strategically chosen to provide an optimal ergonomic interface between the human hand and the keyboard system. The key shape is enhanced by tapering to a narrowed end width, thus allowing a greater tolerance for a finger or thumb to extend past an edge without interfering with the next adjacent key.

18 Claims, 3 Drawing Sheets

ERGONOMIC MUSICAL INSTRUMENT KEYBOARD

FIELD OF THE INVENTION

The present invention relates to keyboard type musical instruments and more particularly it relates to matrix keyboard configurations directed to unified fingering and ergonomic optimization with regard to the human hand.

BACKGROUND OF THE INVENTION

The standard piano keyboard configuration developed in Europe centuries ago has become accepted as a practical compromise solution to the complex problem of interfacing the human hand to a music machine. Its main advantages of relative simplicity, universal acceptance, standardization, and mass-producibility are gained in a tradeoff which burdens the pianist with some disadvantages. Due to the radical difference of the fingering in each of the twelve key signatures, piano students are faced with the formidable task of memorizing the numerous fingering patterns required for scales, chords and arpeggios, to say nothing of musical scores. Even accomplished pianists favor certain key signatures and avoid others. Ironically, in transposing, the smallest step (a semitone) is the most difficult due to the extent of the fingering differences. Another disadvantage is the narrow separation provided between the black keys for playing the white keys: the standard 1.27 cm (0.5") separation poses difficulty for those with large fingers. Because of the major differences between the black and the white keys in size, shape, elevation, distance from the player, etc., and the mismatch resulting from the shape of the human hand, piano playing technique becomes an odd assortment of playing regions and hand/-finger positions that differ from finger to finger.

There are three main key playing regions: (1) the full width portion of the white keys, (2) the narrow portion of the white keys (between the black keys), and (3) the black keys. Each digit of the hand relates differently to each of these three regions; for example, the thumb strongly favors (1), usually requires forward hand movement to reach (2) and has much difficulty with (3), and the small finger also tends to favor (1) due its short length and limited range. Using the thumb or small finger for black keys usually requires a twisting of the wrist. In general the fingers all must adapt to all three positions since the white keys are played at (1) sometimes and at (2) at other times, depending on the playing context. The fingers must be trained to compensate for the different "touch" due to the differences in distance from the key pivot, leverage, relative key mass location and dynamics, etc., not only between the white and black keys but also between the alternative playing regions (1) and (2) on the white keys.

Since region (1) is along a different axis considerably closer to the player as well as lower than the black key region (3), either a backward hand movement or a finger curl is required for a finger to play a (3)-(1) sequence, thus requiring a great deal of arm, hand and finger movement and causing considerable playing inconvenience and fatigue.

In the overall compromise, to accommodate the black keys the nominal white key width (i.e. the center to center spacing) is made 22.9 cm (0.9"), whereas 1.9 cm (0.75") would be adequate for monolithic keys, particularly if the finger shape and position could be kept more natural and consistent and the key shape were enhanced.

Many musicians would welcome an improved musical keyboard system which is more ergonomic, i.e. better matched mechanically to the human hand and which would permit the same fingering in all key signatures while retaining the generally accepted requirement of being able to span at least an octave comfortably with one hand. Furthermore it would be desirable to be able to play practically any of a large number of possible note groupings as chords or arpeggios within the octave without awkwardness or discomfort to the fingers.

A unified fingering system is defined as one in which all of the keys would be of identical shape and disposed in a uniform array: a chromatic scale could be played using one thumb (or finger) with only a linear movement of the hand in an X-axis direction along the keyboard, as opposed to the forward and back (Y-axis) and up and down (Z-axis) finger and hand motion required to play the black and white piano keys due the relative offset of their playing surfaces in both the Y-axis and the Z-axis. For purposes of the present disclosure the axis convention is selected such that a plan view of the keyboard is expressed in X and Y co-ordinates or columns and rows.

A single row keyboard with uniform keys suffers from two main disadvantages: (a) if the keys are made to have adequate width, the span available with one hand is limited to much less than an octave, and (b) a single linear array is poorly matched to the arcuate pattern formed by the different lengths of the thumb and fingers of the human hand.

Another drawback of conventional piano keys is that the white keys, being rectangular, are closely spaced all the way to the end so that a finger extending past a key edge is likely to play an unwanted adjacent note.

DISCUSSION OF PRIOR ART

In recognition of the shortcomings of the standard piano keyboard system, Von Janko and Reuther, in U.S. Pat. Nos. 360,255 and 2,203,393 respectively, disclosed multi-row matrix keyboard patterns (six and three rows respectively) in which adjacent keys were assigned whole note intervals, i.e. two semitones, and adjacent rows, pitched a semitone apart, were offset a half keywidth. While this arrangement provides advantages of common fingering in different key signatures and a reduced octave span one white keywidth shorter than in a piano keyboard, it has the disadvantages that (a) chromatic scales or chord progressions require a zig-zag fingering path, (b) there is no X-axis note duplication offset to facilitate fingering, and (c) keys in the lower left and upper right hand corner regions tend to contribute little if any playing utility or benefit.

Single-plane keyboards which may be capable of a form of unified fingering system have been disclosed in U.S. Pat. No. 4,031,800 to Thompson for a 16 by 16 matrix keyboard, and U.S. Pat. No. 3,342,094 to Wilson for a diagonal matrix keyboard. Like Von Janko and Reuther, Wilson assigns whole note intervals to adjacent keys.

U.S. Pat. No. 4,926,734 to Rickey exemplifies a keyboard configuration which fails to provide unified fingering due to the variety of key shapes and due to the pitch intervals being made a whole tone along each row.

OBJECTS OF THE INVENTION

It is a primary object of the present invention to provide an improved musical keyboard which allows a unified fingering system, i.e. common fingering for chords and sequences in all key signatures for both right hand and left hand playing.

It is another object to provide a musical keyboard in which a chromatic scale can be played along a linear fingering path and thus a chromatic chord progression can be played along a linear lateral hand movement path for both right hand and left hand playing.

It is another object to provide a musical keyboard in which key shape and pivot action are identical for all keys.

It is another object to maintain an acceptable uniform key width while providing a one octave span no greater than that of a piano, i.e. approximately 16 cm (6.3").

It is another object to provide a correspondence between incremental pitches of the keys and the incremental fingers of the hand, i.e. the right thumb always plays the lowest pitch and the little finger always plays the highest pitch.

It is another object to provide an enhanced key shape which increases the tolerance for a finger or thumb to extend beyond the edge of a key without interfering with the next adjacent key.

It is another object to provide a multi-level musical keyboard which facilitates fingering by providing note duplication in designated ranges at a strategic offset on adjacent keyboard rows, while minimizing low-benefit note duplication.

It is another object to provide a musical keyboard which may be interfaced with piano, organ, harpsichord and synthesizer technologies.

It is another object to provide a musical keyboard which is tactilely and visually pleasing.

SUMMARY OF THE INVENTION

The above-stated and other objects and advantages have been realized in the present invention of an ergonomically advanced matrix keyboard system, providing a unified fingering system with comfortable thumb and finger positioning while providing a hand span capability comparable to that of the conventional keyboard. Three or more parallel horizontal keyboard rows are strategically located offset from each other in X, Y and Z axes forming a diagonally-tiered array with selected note groups duplicated in adjacent rows in an offset pattern which provides an easy octave span, unified fingering independent of key signature, and chromatic performance with linear hand movement. All keys are made to have a uniform enhanced shape and are secured in an integrated matrix pivot system. Notes and keys are associated visually by providing keys of at least two easily distinguishable colors or shades.

BRIEF DESCRIPTION OF THE DRAWINGS

The above-stated and further objects, features and advantages of the present invention will be more fully understood from the following description taken with the accompanying drawings in which.

DETAILED DESCRIPTION

Figure 1:
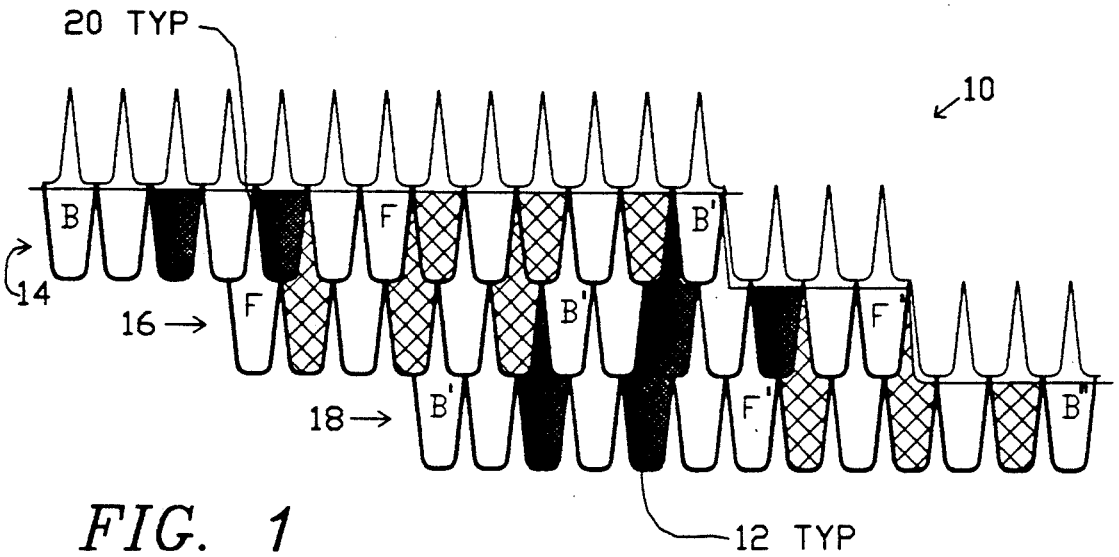
FIG. 1 is a plan view of the keys of a keyboard in accordance with the present invention in an illustrative embodiment.

FIG. 1 shows a plan view of a musical keyboard 10 in an illustrative embodiment of the present invention having 39 identically shaped keys 12 arranged in three rows 14, 16 and 18. It will be noted that keys 12 are tapered to be narrower at their front ends (i.e. the downward facing ends as shown), and their top portion extends rearward in the shape of wedge-shape 20 which fits into the triangular space between adjacent keys of the next row above.

The separation between the ends of keys 12 serves to provide keyboard enhancement relative to conventional rectangular shaped keys which are closely adjacent: with the tapered shape as shown, there is greater tolerance for a finger or thumb to extend beyond the edge of the key without interfering with an adjacent key.

The three rows are physically identical, each having 13 keys which are assigned notes incrementing in half tones to thus cover a full octave; row 14 covers the octave from middle B to high B (B'), row 16 from F to F' and row 18 from B' to B", thus providing a total range of two octaves. The seven uppermost notes in row 14 are duplicated as lowermost notes in row 16, and similarly the seven uppermost notes in row 18 as duplicated as lowermost notes in row 18. In physical terms, row 16 is offset to the right from row 14 by a row offset dimension of 3½ keywidths, and in musical terms row 16 the note duplication offset is said to be 2½ semitones (or 2½ keywidths) to the left, as indicated by the relative positions of the duplicated F as shown. It will be seen that the row offset and note duplication offset of row 18 relative to row 16 are the same as for row 16 relative to row 14.

Figure 2:
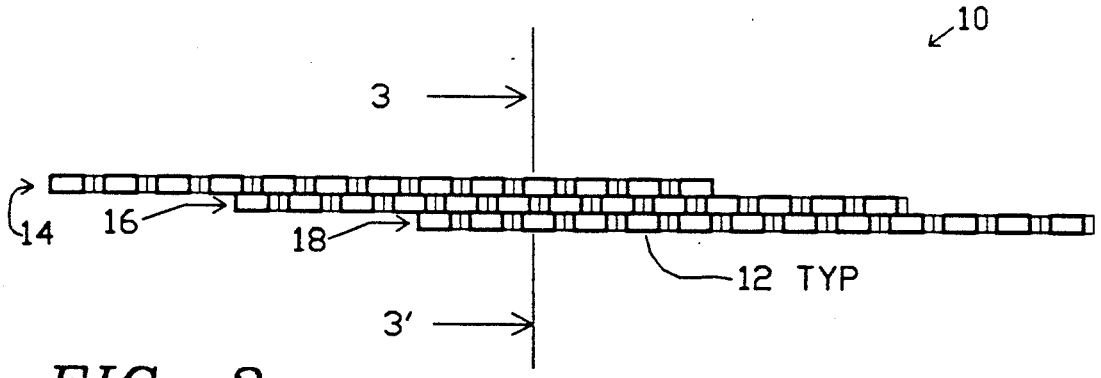
FIG. 2 is a frontal view of the subject matter of FIG. 1.

FIG. 2 is a frontal view of the keyboard of FIG. 1, where it is seen that the three row are set at different elevations, with row 14 uppermost and row 18 lowermost.

Referring now to FIGS. 1 and 2 taken together, it is seen that the overall keyboard shape may be described as a tiered matrix with an overall parallelogram shape and that starting with the first row 14, each adjacent row is offset uniformly in three directions, i.e. the X, Y and Z axes.

It should be apparent that it would be possible to extend the keyboard 10 to the right and/or left by adding any desired number of offset rows in a consistent and systematic manner to obtain a desired overall range of musical notes, and the overall shape of the keyboard would always have an overall parallelogram shape with the rows diagonally offset from each other in three dimensions.

For a human hand positioned naturally over the keyboard 10 there are numerous optional fingerings for a given chord (or sequence of notes), and having selected the most appropriate fingering, the chord may be transposed to another key signature and played without any change of fingering or hand shape by merely moving the hand to a new position on the keyboard. For a chord involving three rows, the hand movement would be sideways only. For a chord involving only two rows, there may be a choice of playing a transposed replica of the chord on either pair of rows, thus providing two nearby duplicated and thus alternative playing positions. If the chord involves only a single row, there may be alternative playing positions on adjacent rows.

An octave span from the first row 14 to the third row 18 may be made 16 cm (6.3": equal to that of a piano) with a keywidth of 1.9 cm (0.75") and key length (i.e. Y axis row offset) of about 4 cm. (1.6"). The adjacent row octave span would be 18.6 cm (7.3").

When playing scales and arpeggios on a standard piano keyboard, the musician the thumb to transfer the hand from location to location on the keyboard. The thumb naturally tucks under the hand and fingers. This physical attribute promotes transferring the hand to the rows below the original row. For example, providing a reachable duplicate of the fifth key in the C major scale (i.e. G) one row below allows opportunities for rapid hand location transfers from one row to an adjacent row when playing that scale: the thumb would hit the tonic (i.e. C) and also the fifth (i.e. G) in the next row down. This procedure remains constant for all other scales.

If, instead of the overall parallelogram shape shown for the present invention, the keyboard were to be made rectangular of equal overall dimensions, there would be an additional 20 keys. It is a discovery by the present inventor and a principle of this invention that in a rectangular keyboard array directed to unified fingering, the keys in the lower left and upper right regions are of low utility, and that by eliminating those low utility keys from a rectangular array to make it a parallelogram, not only is a keyboard of given size made more cost and size effective, but its design may be more readily expanded in an efficient and systematic manner in a three dimensional diagonal direction to any desired musical range.

Figure 3:
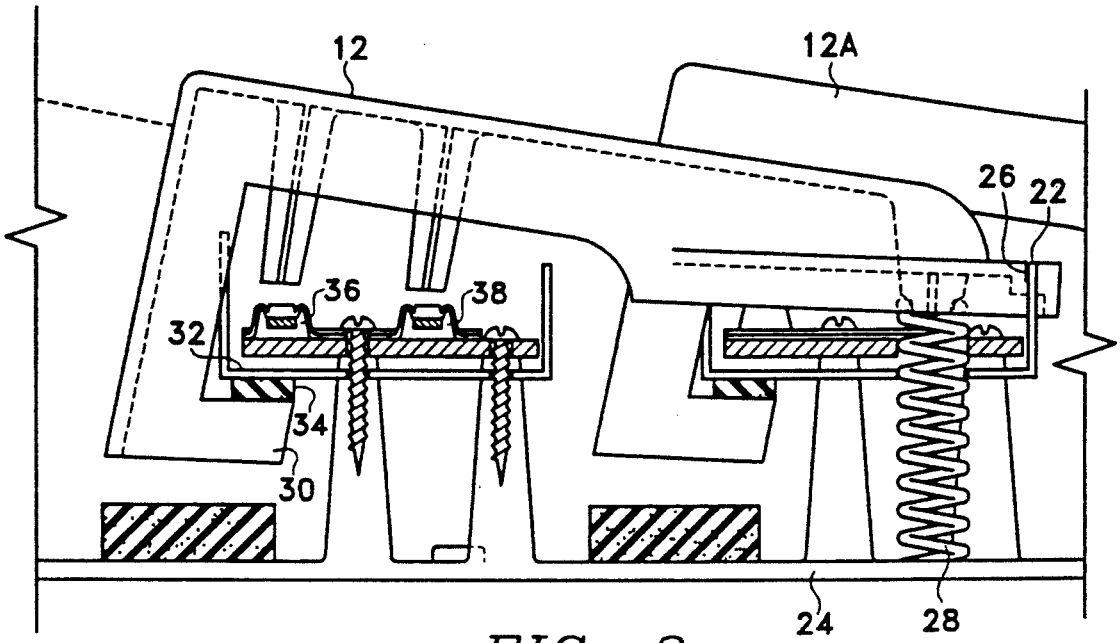
FIG. 3 is a cross-sectional view of a portion of the subject matter of FIG. 2 showing a typical key along with associated functional structure and a portion of a neighboring key in the adjacent upper row.

FIG. 3 is a cross sectional view of a keyboard of this invention taken at axis 3-3' of FIG. 2 showing a typical key 12 along with associated functional structure and a neighboring key 12A in the adjacent upper row. A pivot member 22, secured to portion of a baseplate 24, engages a pivot groove in an extended rear lower portion of key 12. A coil spring 28, under compression against the baseplate 24, urges key 12 upwardly against constraint provided by a flange 30 extending rearward from the lower front region of the key 12, bearing against a stop part 32, via a resilient pad 34. A pair of contacts 36 and 38 are normally open-circuited. Key 12 is offset from neighboring key 12A by a half keywidth along the X-axis (Refer to FIG. 1).

Figure 4:
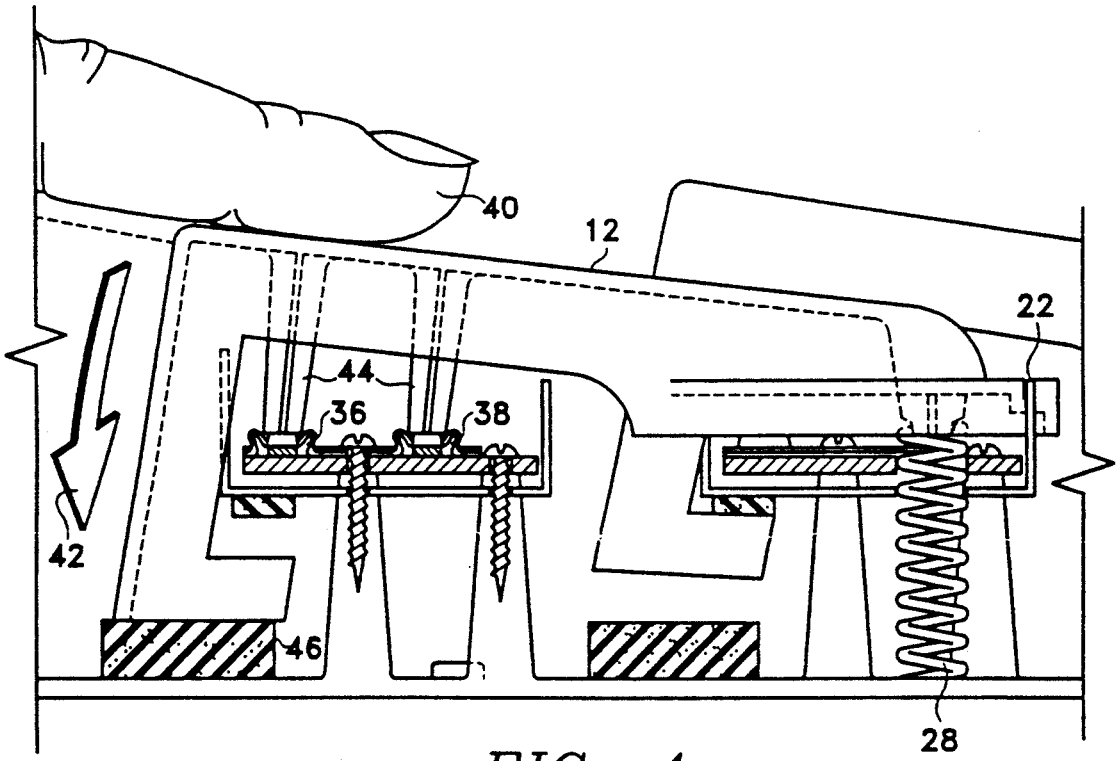
FIG. 4 shows the key of FIG. 3 in a depressed disposition.

FIG. 4 shows the subject matter of FIG. 3 with the key 12 depressed by a human finger so as to move the key downward as indicated by the arrow 42, against the force of spring 28 and pivoting at pivot part 22. A pair of downward-extending studs 44 molded into key 12 engage contacts 36 and 38 and cause them to close sequentially, so as to provide a time delay for velocity sensing in a well known manner of electronic keyboards.

Figure 5:
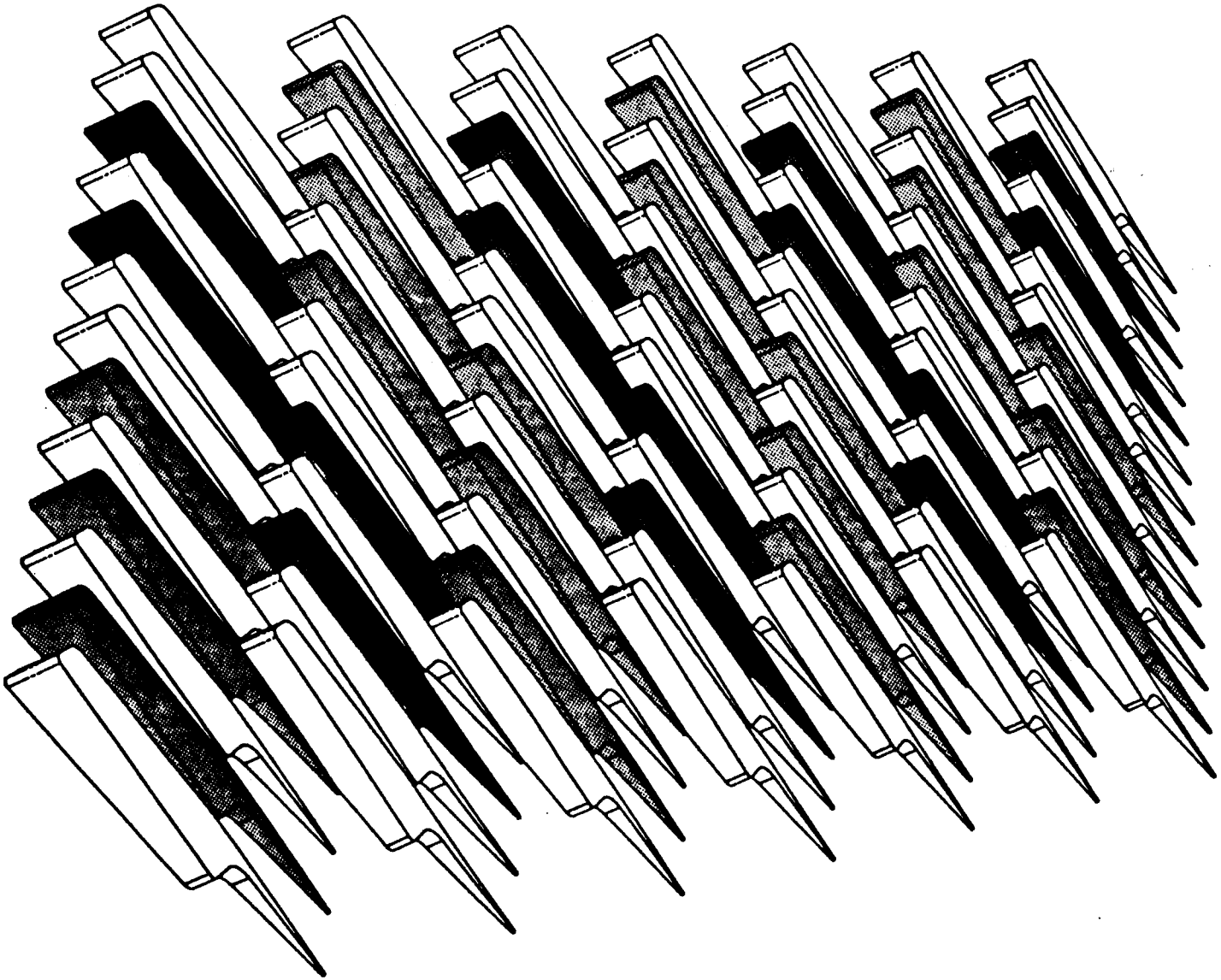
FIG. 5 is a ¾ perspective view of a seven row keyboard in accordance with the present invention.

FIG. 5 is a three dimensional view of a keyboard according the present invention having seven rows of keys, each row providing a chromatic scale with a one octave range, i.e. 13 keys. Starting from the first (upper) row 14A, each successive row downward is seen to be offset to the right by 3½ keywidths. In this instance, assuming the first row 14A covers the range from B to B', the C♯ and D♯ keys are identified as black in color (as in FIG. 1). According to the 2½ keywidth note duplication offset system of this invention as described above in connection with FIG. 1, the second row will cover the range from F to F', the third row from B' to B" and so forth, so that overall the keyboard of FIG. 5 will cover a total range of 4 octaves.

If the three-row two octave embodiment FIG. 1 is taken as a basis, it is seen that in extending the design to additional rows, each row added increases the range by ½ octave, and regardless of how many rows are added, the effective Y-axis keyboard dimension remains at three rows of keys along the entire keyboard.

The invention could be practiced with other numbers of rows and other numbers of keys per row; however it is believed that less than three rows or less than 12 keys per row would introduce serious limitations, while more than 16 keys per row yields little if any additional benefit.

This particular degree of row offset and note duplication offset has been developed as being optimal with regard to key width and hand span considerations, however there is a tolerance range around each of the two offset parameter values within which the invention may be practiced as a viable and useful keyboard configuration. Generally these offset parameters will be an odd number of half keywidths. It is believed that useful benefits may derive from keyboards made in accordance with principles of the present invention having rows offset to the right in a range from 3 to 11 half keywidths and note duplication offset to the left in a range from 1 to 9 half keywidths when adding rows of keys below the original row.

Regarding the end shape of each key 12, the enhancement provided by the present invention derives from the tapered key shape and the space left between the keys at and near their extremity, with the exact shape at the extremity being subject to a degree of latitude within which the invention may be practiced successfully, including the squared-off end shape shown in FIG. 1 and the rounded end shape shown in FIG. 5.

Regarding key identification, in addition to the three tone scheme indicated (white, gray and black as in FIGS. 1 and 5), there are alternatives with which the invention could be practiced: for example, using only white and black, using colors rather than white, gray and black, or placing a special texture or other identifying attribute on particular keys.

The left hand is able and well suited to play the basic keyboard embodiments of the present invention such as those shown in FIGS. 1 and 5, however the fingering differs from that of the right hand for identical passages. In an alternative embodiment of the keyboard of this invention, which would make the left hand fingering identical with that of the right hand for identical passages, the basic "right hand" keyboard array as shown may be supplemented by a "left hand" keyboard array configured in a mirror image pattern.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. An ergonomic musical keyboard system enabling unified fingering common to all key signatures, comprising:

a plurality of at least three elongated horizontal rows of at least twelve side-by-side substantially similar keys which can be depressed and thus played by digits of a user's hand, each key having an upward-facing playing surface extending to a forward-facing key end, said rows being stacked and uniformly tiered such that an upper and lower row of each pair of adjacent rows are offset from each other such that the lower row is offset in a forward direction, toward the user's location, relative to the upper row, thus exposing the playing surfaces of the keys to form an overall matrix pattern wherein keys from up to three rows may be selected for playing by the digits of the hand from a typical hand playing position; and musical pitch value selection means operationally coupled to each of said keys such that each row of keys when played from left to right produces chromatically incrementing pitch values each assigned to a corresponding one of the keys;

each of said rows being allocated a particular range of pitch values such that in each adjacent pair of rows a predetermined portion of the total pitch range of each row is common to both rows, the common pitch range portion of each row being physically offset along the X-axis relative to the common pitch range portion of the other row by a distance which is chosen to maximize musical performance capability and which is defined as a pitch value duplication offset.

2. The ergonomic musical keyboard system as defined in claim 1 wherein the pitch value duplication offset is made to be in a range from one to nine half-keywidths, the common pitch range portion of the lower row of each adjacent pair of rows being offset in a left hand direction relative to that of the upper row of the pair.

3. The ergonomic musical keyboard system as defined in claim 1 wherein each successive row after the uppermost is physically offset to the user's right by a distance defined as a row offset designated to be seven half-keywidths in a right hand direction, and the pitch value duplication offset is designated to be five half-keywidths in the left hand direction.

4. The ergonomic musical keyboard system as defined in claim 1 wherein all of said keys are made identical in shape, each key being made to have a substantially flat playing surface, and being shaped to have substantially a full keywidth in a central region thereof, tapering to a narrowed key-end width, and being shaped in an upper rear region thereof so as to form a backward-pointing wedge dimensioned to fit into a V-shaped gap formed between tapered front portions of two adjacent keys in a next upwardly adjacent row, the key being formed to have a lower rear region of substantially full keywidth and to define, near a rear extremity of the key, an upward-facing transverse U-shaped groove configured and dimensioned to engage a pivot member, the U-shaped groove being located below the adjacent keys in the next upwardly adjacent row and thusly concealed from view.

5. The ergonomic musical keyboard system as defined in claim 4 further comprising in a matrix pivot system:

a plurality of pivot members each engaging a corresponding one of said keys via the upward-facing groove, a plurality of support members, disposed on a common base structure, made to locate said pivot members in accordance with said rows, being uniformly tiered diagonally, such that in each pair of rows, the backward-pointing wedge on each of a designated group of keys in the lower row is made to fit into the corresponding V-shaped gap formed between tapered front portions of adjacent keys in the upper row;

a plurality of stopping members adapted to limit upward travel of each key at its forward-facing end; and a plurality of spring members adapted to each act on one of said keys in a manner to urge the key upwardly against a corresponding pivot member and a corresponding stopping member, and to allow the key to be depressed by a player so as to actuate note selection means such as electrical contacts.

6. The ergonomic musical keyboard system as defined in claim 1 wherein each of said rows comprises at least twelve of said keys.

7. The ergonomic musical keyboard system as defined in claim 1 wherein each of said rows comprises thirteen of said keys.

8. An ergonomic musical keyboard system enabling unified fingering common to all key signatures, comprising:

a plurality of identically shaped keys each having a substantially flat upward-facing playing surface, the key being made to have substantially a full keywidth in a central region thereof, tapering to a narrowed width at a forward-facing key end, the key being shaped in an upper rear region thereof so as to form a backward-pointing wedge dimensioned to fit into a V-shaped gap formed between tapered front portions of a pair of adjacent keys displaced from said key upwardly and in a rearward direction, said key being formed to have a lower rear region of substantially full keywidth extending beyond the wedge and defining on an upper extended surface of the lower rear region an upward-facing transverse U-shaped groove adapted to engage a corresponding cooperating pivot member;

a plurality of at least three like elongated horizontal keyboard rows each comprising thirteen of said keys, said rows being uniformly tiered diagonally from an initial row to a final row, the final row being offset in a right hand direction, disposed at a lower elevation and extending further forward relative to the initial row, each pair of adjacent rows having a lower row offset horizontally in a right hand direction from an upper row by a row offset dimension designated to be an odd number of half-keywidths ranging from three to eleven in a right hand direction;

musical note selection means operationally coupled to each of said keys such that each row of keys when played from left to right produces chromatically incrementing notes each assigned to a corresponding one of the keys, the lower row of each pair of adjacent rows being made to have a group of adjacent keys in a left hand portion thereof whose assigned notes duplicate those of a group of adjacent keys in a right hand portion of the upper row, the group in the lower row being horizontally offset from the group in the upper row by a note duplication offset dimension designated to be an odd number of half-keywidths ranging from one to nine in a left hand direction;

a matrix pivot system having a plurality of pivot members each engaging a corresponding one of said keys via the U-shaped groove provided in said key;

support structure extending upwardly from base structure, made to locate said pivot members, in accordance with said rows being uniformly tiered diagonally, such that in each pair of rows, the backward-pointing wedge on each of a designated group of keys in the lower row is made to fit into the corresponding V-shaped gap formed between tapered front portions of adjacent keys in the upper row;

a plurality of stopping members, each associated with a corresponding one of said keys, adapted to limit upward key-end travel; and a plurality of spring members adapted to each act on one of said keys in a manner to urge a corresponding one of said keys upwardly against a corresponding pivot member and a corresponding stopping member, and to allow the key to be depressed by a player so as to thus actuate note selection means such as electrical contacts.

9. The ergonomic musical keyboard system as defined in claim 8 wherein the row offset is designated to be seven half-keywidths in a right hand direction, and the note duplication offset is designated to be five half-keywidths in a right hand direction.

10. The ergonomic musical keyboard system as defined in claim 9 comprising at least three rows including a first row constituting the initial row, a second row downward adjacent to the first row and a third rows downwardly adjacent to the second; wherein notes are assigned to the keys in a manner to provide, from left to right, in the first row a chromatic scale from B to B′, in the second row a chromatic scale from F to F′, and in the third row a chromatic scale from B′ to B″, thus providing in the three rows a total range of two octaves in which the final seven notes of the first row are duplicated in the initial seven notes of the second row, and the final seven notes of the second row are duplicated in the initial seven notes of the third row.

11. The ergonomic musical keyboard system as defined in claim 10 comprising seven said rows.

12. An ergonomic musical keyboard system enabling unified fingering common to all key signatures, comprising:

a plurality of at least three parallel rows of identical pivot-action keys, each row extending along a horizontal X-axis and each row comprising at least twelve side-by-side substantially similar keys each having an upward-facing playing surface extending along a Y-axis to a forward-facing key end, said rows being stacked vertically and tiered by a uniform Y-axis offset such that in each adjacent pair of rows a lower row of the pair extends further forward toward a user of the keyboard than an upper row of the pair, the keys and the Y-axis offset being configured and dimensioned so as to form a matrix pattern of key playing surfaces wherein keys selected from up to three adjacent rows may be played from a typical hand playing position;

musical note selection means operationally coupled to each of said keys such that each row of keys when played by the user depressing the playing surfaces of the keys successively from left to right produces a series of musical tones incrementing in pitch in semitone steps, each of said rows being allocated a particular range of pitch values such that in each adjacent pair of rows a predetermined portion of the total pitch range of each row is common to both rows, the common pitch range portion of the lower row of the pair being physically offset along the X-axis relative to the common pitch range portion of the upper row of the pair by a distance which is chosen to maximize musical performance capability and which is defined as a pitch value duplication offset.

13. The ergonomic musical keyboard system as defined in claim 12 wherein the pitch value duplication offset is made to be in a range from one to nine half-keywidths in a left hand direction such that, in each pair of adjacent rows, the common pitch range portion of the lower row is offset to the user's left relative to the common pitch range portion of the upper row of the pair.

14. The ergonomic musical keyboard system as defined in claim 12 wherein all of said rows are made equal in length and wherein said rows are uniformly offset along the X-axis thus forming an overall parallelogram shape such that the uppermost row extends furthest to the user's left and the lowermost row extends furthest to the user's right, each adjacent pair of rows being mutually offset by a distance defined as a row offset.

15. The ergonomic musical keyboard system as defined in claim 14 wherein the row offset is made to be in a range from three to eleven half-keywidths.

16. The ergonomic musical keyboard system as defined in claim 13 wherein the pitch value duplication offset is made to be five half-keywidths in the left hand direction and wherein the row offset is made to be seven half-keywidths.

17. The ergonomic musical keyboard system as defined in claim 16 having three said rows, each row having thirteen keys, said rows comprising:

a top rear row having a pitch range from B to B′;

a middle row having a pitch range from F to F′; and a bottom front row having a pitch range from B′ to B″.

18. The ergonomic musical keyboard system as defined in claim 16 comprising seven said rows.

* * * * *